US005390725A

United States Patent [19]

Berclaz et al.

[11] Patent Number: 5,390,725

[45] Date of Patent: Feb. 21, 1995

[54] CASTING MACHINE FOR VERTICAL CONTINUOUS CASTING IN A MAGNETIC FIELD

[75] Inventors: Georges Berclaz, Veyras; Bertrand Carrupt, Chamoson; Miroslaw Plata, Vétroz, all of Switzerland

[73] Assignee: Alusuisse-Lonza Services Ltd., Zurich, Germany

[21] Appl. No.: 123,109

[22] Filed: Sep. 20, 1993

[30] Foreign Application Priority Data

Oct. 6, 1992 [CH] Switzerland ..... 3116/92

[51] Int. Cl.[6] ..... B22D 11/124; B22D 27/02

[52] U.S. Cl. ..... 164/467; 164/444; 164/487; 164/503

[58] Field of Search ..... 167/467, 503, 487, 444

[56] References Cited

U.S. PATENT DOCUMENTS

| | | | |
|---|---|---|---|
| Re. 32,529 | 10/1987 | Vives . | |
| 4,307,772 | 12/1981 | Haller | 164/467 |
| 4,572,280 | 2/1986 | Haller . | |
| 4,699,204 | 10/1987 | Sautebin et al. . | |
| 5,148,856 | 9/1992 | Mueller et al. | 164/487 |

FOREIGN PATENT DOCUMENTS

| | | | |
|---|---|---|---|
| 1-215439 | 8/1989 | Japan | 164/503 |

*Primary Examiner*—Kuang Y. Lin

*Attorney, Agent, or Firm*—Bachman & LaPointe

[57] ABSTRACT

The casting machine features a mold (10), a deflection plate (66) with a lower surface (80) for guiding cooling water (20) which is sprayed at high pressure and/or a supporting plate with an upper surface for guiding cooling water (20) flowing at low pressure. Both surfaces for guiding the cooling water (20) are made of insulating material. The electromagnetic shield (18, 76) is cooled on the inside at least in the active region. The mold housing (32) is preferably made out of a perforated sheet (34) which has been bent several ways. The active region of the shield is preferably in the form of a U-shaped or V-shaped shielding sheet and features an insert or coating for reducing the magnetic field of the inductor (12) increasingly in the upwards direction. The water-jetted surface (80) for guiding the cooling water is moved continuously backwards and forwards and/or tilted in a given rhythmic manner. As a result the curtain of water (22), which is independent of the electromagnetic shield (18), is moved up and down over the ingot (14) over a height (h).

24 Claims, 4 Drawing Sheets

CASTING MACHINE FOR VERTICAL CONTINUOUS CASTING IN A MAGNETIC FIELD

BACKGROUND OF THE INVENTION

The invention relates to a casting machine which has at least one exactly and reproducibly equipped, water-cooled mold for continuously casting a vertical ingot in the magnetic field of a closed peripheral, partially shielded inductor, cooling water channels directed at the ingot at an acute angle via at least one guiding, deflecting surface on which a film of water forms, and for each mold a corresponding dummy base that can be lowered. Further, the invention relates to a process for cooling an ingot in a casting machine.

Continuous chill casting of metals produces slabs or logs that are several meters long and serve as starting material for various subsequent processing steps such as extrusion, rolling or forging.

The most important past of a continuous casting machine are the molds which in conventional processes determine the cross-section of the cast ingot. A casting machine is, depending on the number of slabs or logs being cast, fitted with the corresponding number of dummy bases that can be lowered and are attached to a casting platform.

As the mold slowly starts to fill with molten metal, the metal on the dummy bases starts to solidify. The latter are cooled and lowered at such a rate that the solidus line of the solidifying metal always remains within the frame of the mold. The ingots, the solidification of which is accelerated by water-cooling, increase in length downwards at the same rate as the dummy bases are lowered i.e drop rate. For a given length of ingot the casting process is carried out without interruption.

Among the most important parameters in continuous casting are a correctly controlled drop rate and the cooling of the metal at the right place with the right intensity. These parameters have a strong influence on the surface of the cast ingot. Unfavorable control of these parameters can lead to segregation, liquid metal penetrating the solidified skin, the latter tearing open, or chalk deposition. Electromagnetic casting (EMC), which has reached industrial maturity only in recent times, is based on complete elimination of mechanical contact between the mold and the solidifying metal. The liquid metal is kept exactly in the cross-sectional shape of the ingot by means of controllable electromagnetic forces.

The EMC process not only enables a homogeneous internal structure to be achieved but also a smooth surface of solidified metal, which leads to better physical and chemical properties in extrusion billets, forging blanks and rolling slabs. Expensive processing steps such as the removal of the surface skin or edge trimming are no longer necessary with the EMC process.

Very important in electromagnetic casting is the start-up phase as the solidification front is kept within a narrow height range of about 10 mm. This is necessary because the electromagnetic forces have to compensate for the metallostatic force of the melt above the solidification front. For that reason it is essential to have complete control of the cooling, especially during start-up. The drop rate and the cooling for specific alloys and ingot dimensions have to be optimized on a time basis.

Curvature of the ingot bottom and local crack formation can to a large degree be eliminated if the effect of thermal shock and the intensity of the cooling water can be reduced:

By using cooling water containing carbon dioxide the intensity of cooling can be reduced by about a factor of 5. The use of water containing $CO_2$ is however accompanied by some disadvantages. The carbon dioxide has to be contained in gas bottles under pressure, transported and stored. Further, the cooling water containing $CO_2$ has to be kept under high pressure until shortly before use, which in turn leads to higher expenditures in terms of design and materials.

Another varient makes use of pulsed, sprayed cooling water at least during the start-up phase. This method has proved itself with most aluminum alloys; in the case of hard alloys, however, hair-like cracks can form.

The downwards wedge-shaped electromagnetic shield for known EMC machine molds fulfils two functions simultaneously:

The material used for the shield, stainless steel, absorbs the electromagnetic forces forming the ingot increasingly with increasing thickness. This leads to additional heating.

The polished outer surface of an inclined pan of the shield acts first as a surface to guide the cooling water, and such that initially a film of cooling water forms on that surface, then a curtain of water is sprayed onto the ingot. As a side effect, the shield is cooled by the impinging water. Stainless steel for example is a particularly poor thermal conductor.

Consequently there are some problems with conventional EMC molds:

A chalk deposit forms on the polished outer face of the electromagnetic shield, the surface guiding the cooling water, which leads to an imperfect film of cooling water and inadequate cooling of the EMC shield. As this cooling must be adequate, large maintenance costs are unavoidable.

The EMC shield is rigidly attached to the mold, therefore the position of the surface guiding the cooling water can not be altered.

The various components of the mold are made of aluminum, iron, and copper, which can lead to corrosion problems.

SUMMARY OF THE INVENTION

The object of the present invention is to develop a casting machine of the kind discussed above which, thanks to the simple design and the small electromagnetic energy losses of the molds, is more economical both with respect to manufacturing costs and operating costs. The molds should be flexible in the application of cooling water, and be cooled by a method that is more sensitive than has been the case up to now.

With respect to the the casting machine, that object is achieved by way of the invention in that the surface(s) of the mold for guiding the cooling water is/are of an insulating material, and the electromagnetic shield is cooled from within at least in the the active region. Special, further developed forms of the casting machine are discussed below.

In a particularly advantageous form of the invention the mold housing is made from approx. 3 mm thick stainless steel sheet perforated by holes, bent several ways and with sidewalls welded onto it. Compared to the present state-of-the-art this represents huge progress both from the economical and technical standpoint. In the present invention the expensive formed metal parts, which are massive and usually made of aluminum, can be made from a stainless steel sheet metal housing, the same material as the shield. Because of the large amounts of coolant involved, molded parts out of plastic can be fitted into the sheet metal housing; this results in huge advantages both in respct to manufacturing and economies. In addition, the above mentioned corrosion problems are totally eliminated.

Further advantages accruing out of the use of bent sheet mold housings are that the electromagnetic energy loss is smaller and, as the varient involves almost only one single part, there are no sealing problems.

The surface for guiding the cooling water, made of an insulating material, is preferably the surface of a deflection plate which is a separate component and, usefully, can be replaced. The continuous, intensive cooling permits this to be made out of plastic which is simple for fabrication purposes and very inexpensive. The deflection plate can preferably be displaced and/or tilted and can be set in position by conventional means. The cooling water, which cannot be altered in direction before striking the shield, can then be deflected within a given range of angle. In other words the level at which the curtain of water formed on this surface is sprayed onto the ingot is adjustable, for example over a range of 5 to 20 mm when the mold height cannot be adjusted.

Compared with the deflection of cooling water onto a deflection surface of a rigidly mounted magnetic shield, this represents significant progress. The curtain of cooling water can be applied by simple means to that area where an optimum effect can be realized.

By providing longitudinal grooves in the surface of the deflection plate it is possible to improve the uniform formation of the water film. Longitudinal here means in the direction of flow of the cooling water.

Hard aluminum alloys for example are cast at a lower drop rate, at the same time using less cooling water. Jetting with a lot of water acting under relatively high pressure on the deflection surface results in an largely uniform film of water. In contrast to this, if the amount of water is small and it strikes the deflection surface at too low a pressure, the cooling water runs off without forming a film. As a result, it is not possible to achieve optimum cooling. In the mold therefore, it is possible to provide below the deflection plate, a supporting plate which is longer than a deflection plate and lies therefore closer to the ingot.

The cooling water is sprayed onto the supporting plate; at low pressure the surface of the deflection plate is wetted little or not at all. The surface of the supporting plate, facing the deflection plate and made of the same material, is likewise designed as a surface to guide the cooling water. This supporting plate, which like the deflection plate is preferably exchangeable, can also preferably be displaced and/or tilted, usefully by means of the same drive mechanism as for the deflection plate. Only with a moveable supporting plate is it possible to vary the level at which the curtain of cooling water strikes the ingot.

The supporting plate can feature holes or slits to drain off cooling water. As cooling water drained off in such a manner can never strike the hot ingot, it is possible to reduce the cooling effect even further.

Although the deflection and supporting plates are situated at least partly between the inductor and the electromagnetic shield, they cannot be heated by the electromagnetic field. They are made out of insulating materials, preferably plastic, for example polyethylene or polypropylene. In each case the formation of chalk deposit is much less than on the guide surface of shields of designs known up to now.

Situated in the active region of the inductor is a shield sheet that is bent U-shaped or V-shaped and has water running through it, i.e. is cooled from within and, like the pans of the shield lying outside the active region of the inductor, is preferably made of stainless steel. The shield, closed at the side and preferably made of 1–2 mm thick stainless steel sheets, acts only as a functional pan if an insert or coating of a better shielding material is specified. Otherwise the bent stainless steel sheet functions solely as protection and support.

Known EMC mold shields are also monolithic in the lower region; as mentioned above, they are wedge-shaped. With this large amount of material and external cooling the shielding effect increases in the upwards direction, as required by EMC continuous chill casting.

A version of the mold according to the invention is such that an insert or coating in the U-shaped or V-shaped pan of the shield weakens the electromagnetic effect of the inductor in the upwards direction. This stepwise or continuously increasing electromagnetic shielding is achieved for example by the following measures:

The stainless steel sheet to be bent into a U-shape or V-shape is coated with silver or copper, then bent such that this layer lies on the inside. The coating is performed by conventional means, for example by electroplating, chemical deposition from the gas phase, spray coating, plasma deposition.

The sheet is coated accordingly after being bent into a U-shape or V-shape.

At least one foil or sheet of silver, copper or brass is placed in the U-shaped or V-shaped sheet. This foil or sheet can be bent folded or multilayered, resulting in a steplike or continuous change in thickness, and such that the shielding increases stepwise or continuously in the upwards direction.

By inserting a foil or sheet, or by applying a coating of one of the above mentioned metals, the shielding effect can be increased many times over that of the bent sheet, depending on the material and thickness by a factor of several hundred times.

An insert or coating of silver is usefully 0.05 to 0.2 mm thick, of copper 0.2 to 0.4 mm and of brass 0.5 to 2 mm according to the specific capacity for absorbance; the thickness of this layer can increase continuously or stepwise in the upwards direction.

With respect to the process for cooling an ingot in a casting machine in which the cooling water is sprayed at an acute angle onto a guiding surface, forming a uniform film of water before striking the ingot, that objective is achieved by way of the invention in that the water-jetted surface for guiding the water is displaced backwards and forwards and/or tilted at a desired cycle, as a result the curtain of water, which is independent of the electromagnetic shield, is deflected up and down over a specific height. Special and further developed versions of the process are discussed below.

Using the process according to the invention it is possible to exploit the advantages of pulsed water cooling and to improve on that in that the relatively harsh transition from "cooling" to "not cooling" is much milder and continuous. As a result it is possible to avoid hair-like cracks also in alloys, for example in the hard aluminum alloys.

With respect to time, the guiding deflection surface jetted with water is preferably moved in a sinusoidal manner, in particular with a time interval of 1 to 3 sec. per half wave. As a result the curtain of water preferably completes an upwards and downwards movement of 5 to 20 mm on the ingot. The movement of the water-jetted deflection surface is effected preferably by conventional means driven pneumatically, hydraulically or electromagnetically under microprocessor control.

The cooling water is usefully sprayed at a constant pressure in the range 0.01–0.5 bar starting with the lowering of the dummy base, which corresponds to about 0 to 3 min after the start of casting. In particular the startup phase is difficult. For that reason the movement of the jetted deflection surface can be continued usually for 3–7 min. Of course the movement of the deflection surface is stopped only when the sensitivity of the alloy permits.

The ingot can be vibrated electromagnetically during cooling, in particular continuously.

The advantages achieved by way of the invention can be summarized as follows:

By employing a water-jetted guiding deflection surface that is not heated by the magnetic field, deposition of chalk on the polished surface is avoided and with that the maintenance costs correspondingly reduced.

Using an adjustable water-jetted guiding deflection surface it is possible to adjust the level at which the cooling water curtain impinges on the ingot.

At least in the start-up phase, and/or with particular alloys, the water curtain can be raised and lowered in a cyclic manner that is adjustable. The pulsed water cooling effect can be refined in that the shock effect on suddenly applying the cooling water is eliminated and cooling water is constantly applied to the ingot. As a result no short term overheating occurs.

The addition of $CO_2$, which is normal with EMC casting, is eliminated.

The use of a mold housing of bent stainless steel sheet, the same material as the electromagnetic shield, eliminates corrosion problems The design of the mold housing according to the invention in the form of a folded sheet, in particular a perforated stainless steel sheet, is not restricted to the guiding deflection surface; the same holds for the active region of the electromagnetic shield in the form of a U-shaped or V-shaped stainless steel sheet with an insert or coating.

BRIEF DESCRIPTION OF THE DRAWINGS

The invention is described in greater detail in the following with the aid of exemplified embodiments which are shown in the drawing and are also objects of dependent claims. The drawing shows schematically:

DETAILED DESCRIPTION OF PREFERRED EMBODIMENTS

Figure 1:
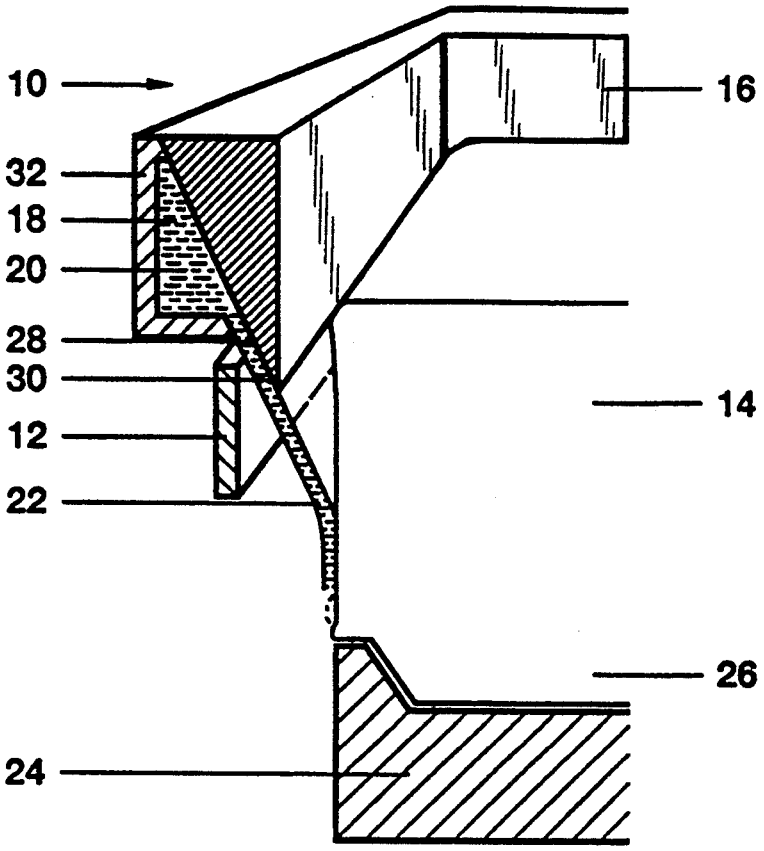
FIG. 1 a state-of-the-art EMC mold in a casting machine.

FIG. 1 shows a generally known basic principle of a casting machine for vertical electromagnetic chill casting of ingots. A casting machine can be fitted with one or more molds 10.

A closed peripheral inductor 12 for a medium frequency, high current system creates a magnetic field and with that the force in ingot 14 which prevents the cast metal from touching the inner wall 16 of the mold.

A wedge-shaped electromagnetic shield 18 partly screens the inductor 12 thus reducing the magnetic field in the upwards direction. Ultimately it is the shield 18 that determines the zone in which the cooling water 20 from space 33 sprays onto the ingot 14 in the form of a curtain of cooling water 22.

A dummy base 24 is mounted on a casting table which is not visible here. During the start-up phase the dummy base shapes the bottom 26 of the ingot 14 and supports it throughout the whole of the casting phase.

This basic principle of magnetic field continuous casting shown in FIG. 1 is improved by way of the invention with respect to the surface 28 for guiding the cooling water, the active region 30 of the electromagnetic shield 18 and the shaped, monolithic mold housing 32; in general however, the basic principle remains essentially unchanged.

Figure 2:
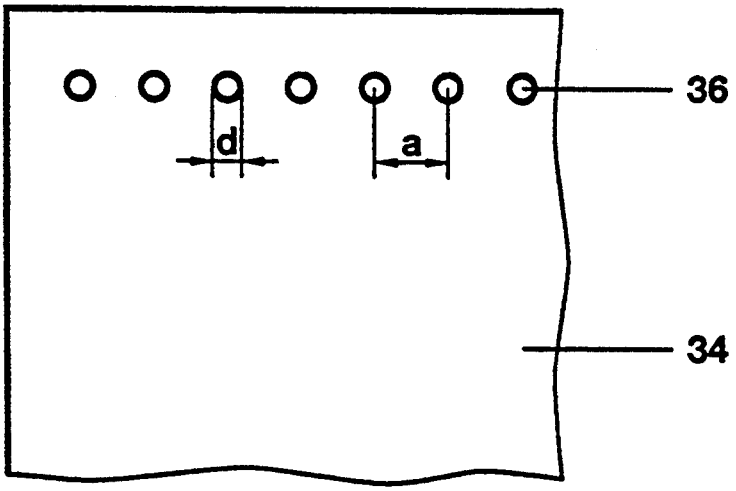
FIG. 2 part of a perforated sheet for a mold housing.

Shown in FIG. 2 is an approx. 3 mm thick stainless steel sheet 34 for manufacturing a housing 32 by bending and welding-on sidewalls. The steel sheet 34 already exhibits, at a uniform spacing of about 10 mm, holes 34 approx. 3 mm in diameter which later serve as outlets for the cooling water.

Figure 3:
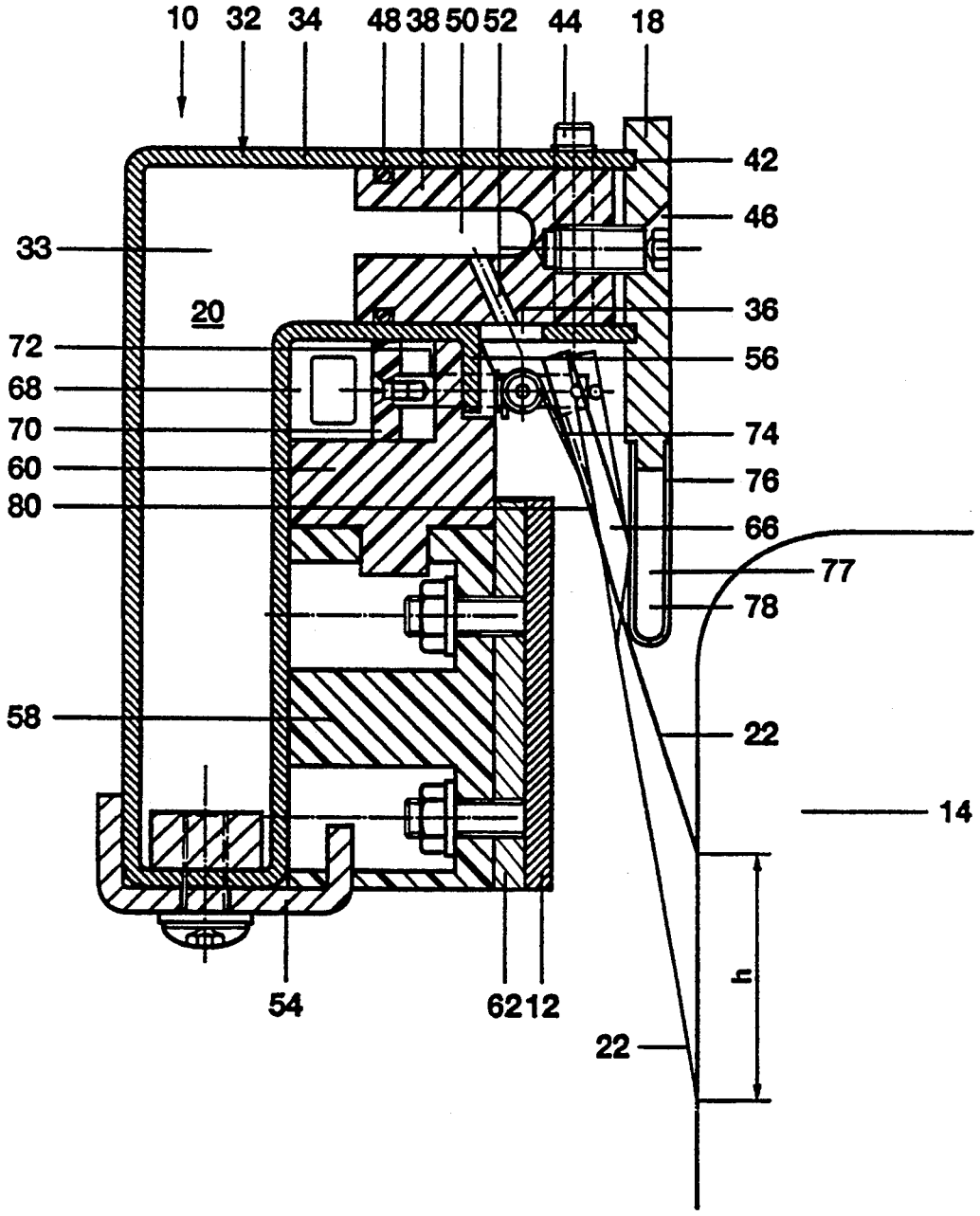
FIG. 3 a section through a mold in the longitudinal direction of the ingot.

The mold 10 shown in FIG. 3 comprises a mold housing 32 out of stainless steel sheet 34 that has been bent several times. The inner space 33 is filled with cooling water 20 and fitted with a plastic block 38 for distributing the water. An electromagnetic shield 18 of stainless steel features two inner facing grooves 42 into which the steel sheets 34 at the open end of the mold housing 32 are inserted. The steel sheets 34 and the plastic water distribution block 38 are penetrated by a bolt 44 onto which a threaded bolt 46 in the electromagnetic shield 18 engages and pulls tightly onto the water distribution block 38, and with that also onto the steel sheet 34.

The water distribution block 38 features a relatively deep groove 50 from which cooling water channels 52 run a regular distance a apart converging on a hole 36 in steel sheet 34. The direction at which the cooling water emerges is determined by the direction of the cooling water channels 52.

By loosening the threaded bolt 46 the electromagnetic shield 18 and, after removing bolt 44 also the water distribution block 38, can be removed or exchanged.

Two interlocking, shaped plastic blocks 58, 60 are joined to the mold housing 32 by means of a bolted-on clamp 54 and a flange 56 made by a bend in the steel sheet 34.

A plate-shaped inductor 12, in the present case made of copper, circumvents the mold interior and is bolted onto the plastic block 58 with an intervening thermally resistant insulating layer 62. Situated in a recess in the plastic block 60 is a setting and moving mechanism for a plastic plate 66 for deflecting the cooling water 20. Inflatable bellows 68 displace, as a function of pressure, a sealing ring 70 bearing a rod 72 which penetrates a corresponding hole in the plastic block 60 and flange 56 of the housing. The deflection plate 66 is hinged to this rod 72. A spring 74, also attached to the rod 72, tilts the deflection plate 66 against the U-shaped sheet 76 of the electromagnetic shield 18. The electromagnetic shielding device 18 is cooled on the inside 77 with water 78 at least in the region of the U-shaped sheet 76 as the water 20 for cooling the ingot 14 does not come into contact with the shield 18 on the outside, in particular not with that sheet 76. The cooling water 20 strikes the deflection plate 66 at an acute angle and at a pressure of e.g. 0.5 bar as it emerges from the water channels 52, flows along the guiding surface 80 of the plate 66 forming a water film, and then as it leaves the deflection plate 66 as a uniform water curtain 22 which strikes the ingot 14 to be cooled.

In FIG. 3 the deflection plate 66 is shown in two extreme positions. The water curtain can strike the ingot 14 in any setting over a height h of 5 to 20 mm, in particular over a height h of 5 to 10 mm. Consequently the mold 10 is very flexible even with a rigid electromagnetic shield. The water curtain can, however, also be raised and lowered continuously for example in a sinisoidal manner.

Figure 4:
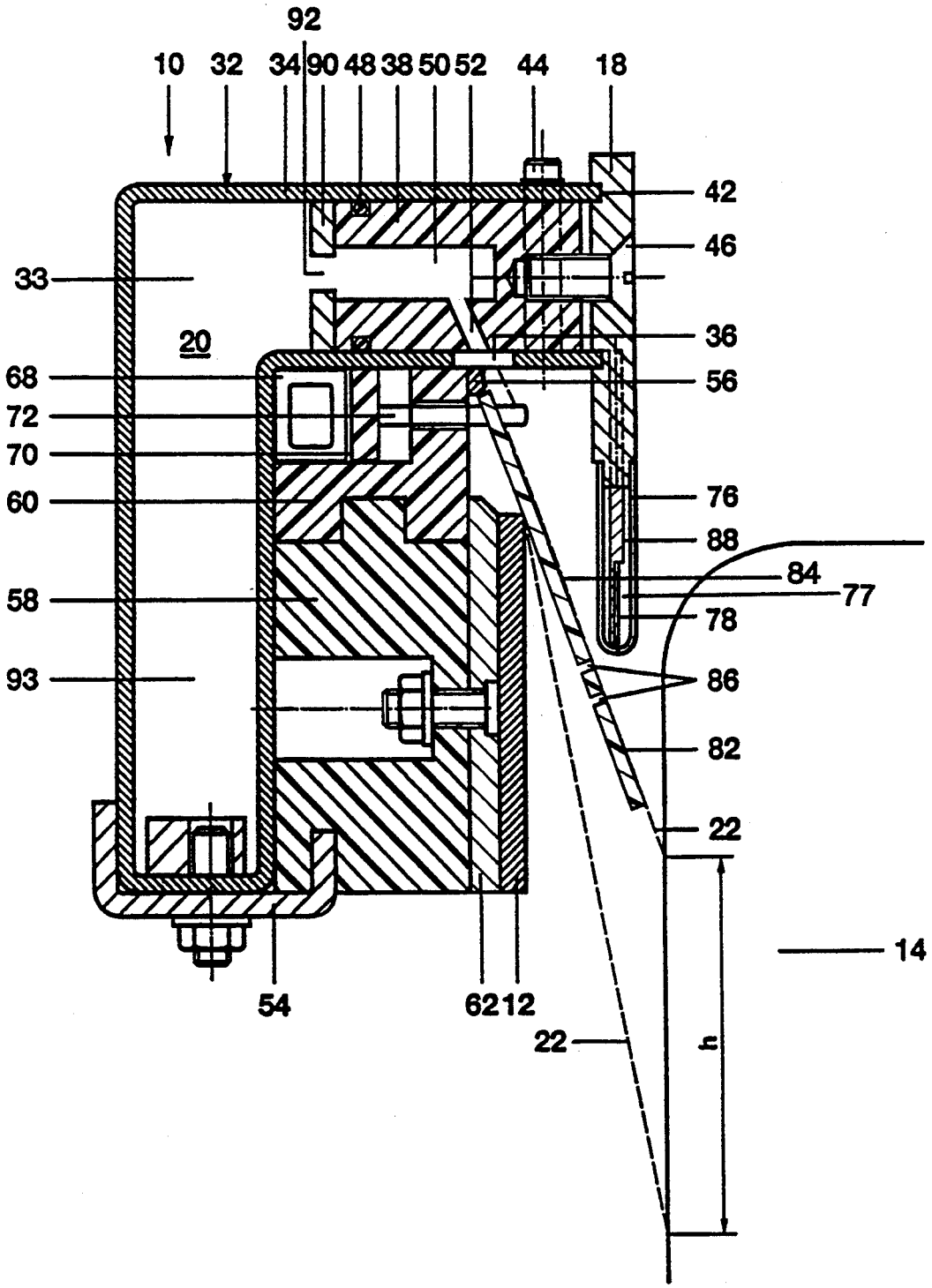
FIG. 4 another version of that shown in FIG. 3.

In the mold 10 shown in FIG. 4 instead of the deflection plate 66 a supporting plate 82 is provided and can likewise be tilted by means of the rod 72 to which it is appropriately attached. This supporting plate 82 is made of plastic and serves to distribute cooling water 20 flowing under low pressure, for example less than 0.05 bar. The cooling water does not reach the guiding surface 84 of the deflection plate 66. In order that the cooling water 20 forming a film on the guiding surface 84 of supporting plate 82 reaches the ingot 14, the supporting plate 82 is designed longer than the deflection plate 66 and extends to a region close to the ingot 14.

The supporting plate 82 features holes or slits 86 to allow some of the cooling water to drain off without touching the ingot 14.

Clamped into the shielding sheet 76 is an inserted sheet 88 of copper which exhibits a high capacity for absorption of the magnetic field generated by the inductor 12. FIG. 4 shows two copper sheets which are joined together by soldering, riviting or adhesive bonding; these provide more pronounced shielding in that region.

Secured to the water distribution block 38, for example by bolts, is a flange 90 with inlet 92 for cooling water 20. As a result a large water chamber 93 and an identical small water chamber with groove 50 in the water distribution block 38 are formed. The flange 90 effects a smoother passage of cooling water 20 into the channels 52.

Figure 5:
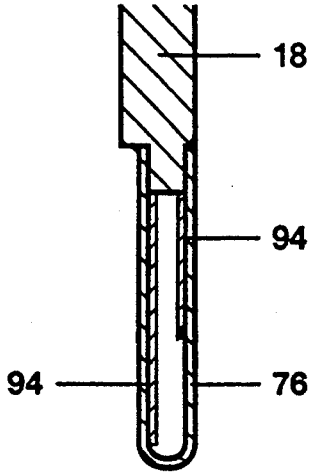
FIG. 5 the active part of an electromagnetic shield.

FIG. 5 shows a detail concerning the active zone of the shield 18 formed by the U-shaped shielding sheet 76 attached to the shield body. Provided on both flanges of the sheet 76 are 0.3 mm thick copper coatings 94 which are different in length. This leads to effective stepwise shielding which, as in conventional versions, is stronger at the top than at the bottom.

Figure 6:
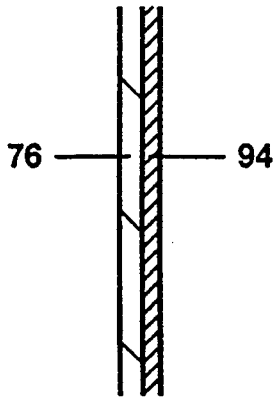
FIG. 6 part of a section through a flange of an electromagnetic shield of the kind shown in FIG. 5, FIG. 7 an insert sheet for an electromagnetic shield, FIG. 8 another version of that shown in FIG. 7.

Another varient is shown in FIG. 6. There, a coating 94 on past of the shielding sheet 76 becomes thicker in the upwards direction and creates therefore a shielding effect that increases continuously in that direction.

Figure 7:
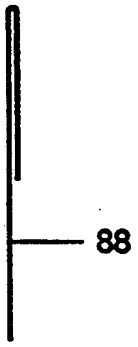

FIG. 7 shows a sheet insert 88 which is bent over from the top down to the middle thereof and is intended for use with a shielding sheet 76 bent into a U-shape or V-shape (FIG. 3,4). The effect regarding electromagnetic shielding is equivalent to that illustrated via FIG. 5.

Figure 8:
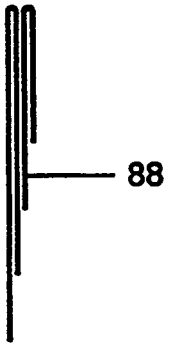

FIG. 8 shows two folded insert sheets 88 which, in comparison with FIG. 7 produce a more gradual change in the shielding effect.

Figure 9:
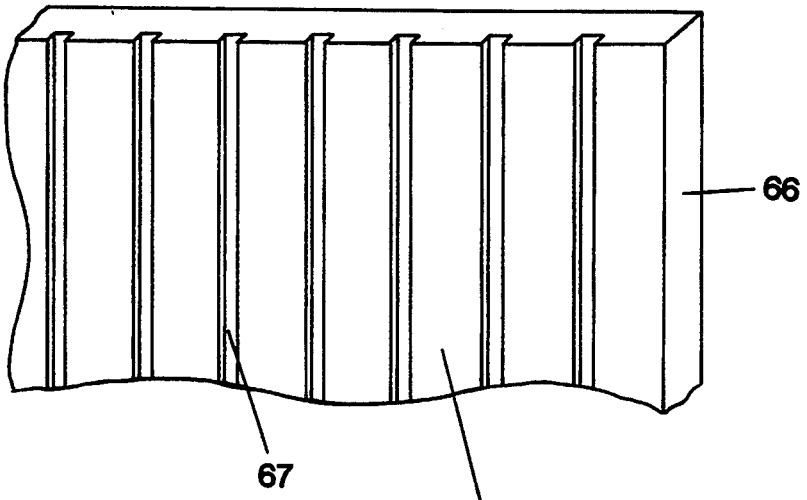
FIG. 9 a version of a deflection plate shown in FIG. 3.

FIG. 9 shows a guiding surface 80 of deflection plate 66 with grooves 67 for conducting cooling water.

We claim:

1. Casting machine for continuously casting a vertical ingot in a magnetic field, which comprises: a water-cooled mold for continuously casting a vertical ingot; means for creating a magnetic field to confine the molten metal including a closed, peripheral partially shielded inductor and an electromagnetic shield; at least one cooling water channel directed at the ingot at an acute angle; at least one guiding surface of an electrically insulating material for guiding said cooling water on which a film of water forms; and a downwards movable dummy base supporting said ingot; wherein the electromagnetic shield is provided with an interior cooling passage.

2. Casting machine according to claim 1 wherein said at least one guiding surface is formed of a plastic material.

3. Casting machine according to claim 1 including a mold housing which has been bent several ways into shape.

4. Casting machine according to claim 3 wherein said housing is a sheet of stainless steel perforated by holes.

5. Casting machine according to claim 3 wherein the mold housing has an open end which is inserted into corresponding inner facing grooves in the electromagnetic shield and bolted thereto.

6. Casting machine according to claim 5 including a water distribution block adjacent said open end, with channels for the cooling water in the distribution block.

7. Casting machine according to claim 1 wherein said guiding surface is the surface of a movable deflection plate.

8. Casting machine according to claim 7 wherein the deflection plate is replaceable, is of plastic, and its surface includes grooves that run in the direction of the cooling water.

9. Casting machine according to claim 1 wherein said guiding surface is the surface of a movable supporting plate that includes a corresponding guiding surface for cooling water.

10. Casting machine according to claim 9 wherein the supporting plate includes openings to drain off cooling water.

11. Casting machine according to claim 1 wherein at least a portion of said shield is adjacent the inductor.

12. Casting machine according to claim 11 wherein said portion of the shield is bent into a shape selected from the group consisting of a U-shape and a V-shape.

13. Casting machine according to claim 11 wherein at least said portion of the shield has a water flowing passage.

14. Casting machine according to claim 11 wherein at least said portion of the shield is made of 1 to 2 mm. thick stainless steel.

15. Casting machine according to claim 11 including means in said portion of said shield to reduce the electromagnetic effect of the inductor increasingly in the upwards direction.

16. Casting machine according to claim 15 wherein the means in said portion is an insert.

17. Casting machine according to claim 15 wherein the means in said portion is a coating.

18. Casting machine according to claim 15 wherein said means in said portion of the shield becomes thicker in the upwards directions in a manner selected from the group consisting of stepwise and continuously.

19. Casting machine according to claim 15 wherein said means in said portion of the shield is selected from the group consisting of silver from 0.05–0.2 mm thick, copper from 0.2–0.4 mm thick and brass from 0.5–2 mm thick.

20. Process for cooling an ingot in a continuous casting machine, which comprises:

continuously casting a vertical ingot in a magnetic field including providing a closed, peripheral partially shielded inductor, providing an electromagnetic shield for shielding portion of an electromagnetic field from the inductor to the ingot and providing a cooling passage in the interior of the electromagnetic shield for cooling the same;

spraying cooling water onto a guiding deflection surface to form a uniform water film thereon;

spraying the water onto the ingot; and displacing the deflection surface to vary the water spray onto the ingot.

21. Process according to claim 20 wherein the water spray onto the ingot is independent of the electromagnetic shield.

22. Process according to claim 21 wherein the deflection surface is moved in a sinusoidal manner.

23. Process according to claim 22 wherein the deflection surface is moved at a timing of 1 to 3 seconds per half wave, moving the water spray onto the ingot up and down over a height of 5 to 20 mm.

24. Process according to claim 21 wherein the deflection surface is moved in a program controlled manner by drive means selected from the group consisting of pneumatic, hydraulic and electromagnetic.

* * * * *